US006668578B2

(12) United States Patent
Coakley

(10) Patent No.: US 6,668,578 B2
(45) Date of Patent: Dec. 30, 2003

(54) GLASS CHILLING METHOD AND APPARATUS

(76) Inventor: David Coakley, 1038 Beacon St. Apt. 204, Brookline, MA (US) 02446

( * ) Notice: Subject to any disclaimer, the term of this patent is extended or adjusted under 35 U.S.C. 154(b) by 0 days.

(21) Appl. No.: 10/375,429

(22) Filed: Feb. 27, 2003

(65) Prior Publication Data

US 2003/0164002 A1 Sep. 4, 2003

Related U.S. Application Data

(60) Provisional application No. 60/361,568, filed on Mar. 4, 2002.

(51) Int. Cl.[7] ..... F25D 25/00

(52) U.S. Cl. ..... 62/378; 62/380; 198/604; 198/612

(58) Field of Search ..... 62/378, 380, 63, 62/382; 198/604, 612, 620, 626.1

(56) References Cited

U.S. PATENT DOCUMENTS 951,323 A * 3/1910 Mathewwson ..... 221/197
2,432,749 A * 12/1947 Glassford ..... 34/65
2,589,099 A * 3/1952 Larkin ..... 194/240
3,622,043 A * 11/1971 Chotard ..... 221/261
3,701,266 A * 10/1972 Chisholm ..... 65/116
3,886,959 A * 6/1975 Stott ..... 134/134
4,676,074 A * 6/1987 Morgan et al. ..... 62/277
5,520,013 A * 5/1996 Kuo ..... 62/380
5,653,044 A * 8/1997 Thom, Jr. ..... 34/217
5,819,937 A * 10/1998 Walker ..... 206/429
6,557,594 B2 * 5/2003 Guzman ..... 141/240

FOREIGN PATENT DOCUMENTS

JP 404327773 A * 11/1992

* cited by examiner

*Primary Examiner*—William E. Tapolcai
*Assistant Examiner*—Mohammad M. Ali
(74) *Attorney, Agent, or Firm*—Robert K Tendler

(57) ABSTRACT

For bartending, in order to avoid batch chilling of beer glasses and the like in which the last glasses put into a refrigerator are the first pulled out and are thus not properly chilled, a last in, last out glass chilling system provides a supply of properly chilled beer glasses even when newly washed warm glasses are to be chilled. In one embodiment, the last in, last out glass chilling system includes a series of trays on a conveyor in the cabinet, with each tray loaded with glasses. The conveyor moves the trays upwardly in the chill cabinet, with the chilling occurring during the time that the tray of glasses moves from a bottom position to a top position. This assures that, unlike batch chilling, properly chilled glasses are always available. In one embodiment, a tray of glasses is in inserted at the base of the chill cabinet, with the conveyor being motorized to move the trays within the chill cabinet in an upward direction. The topmost tray is presented at an upper aperture in the chill cabinet, with the chilled glasses being extractable from this upper aperture. In a preferred embodiment, the trays are slanted downwardly such that glasses on the trays move by gravity towards this upper aperture.

13 Claims, 8 Drawing Sheets

GLASS CHILLING METHOD AND APPARATUS

This application claims the benefit of provisional application 60/361,568 filed on Mar. 4, 2002.

FIELD OF INVENTION

This invention relates to apparatus for chilling glasses and more in particularly to a last in, last out method for chilling glasses.

BACKGROUND OF THE INVENTION

In a busy bar, the number of beer glasses to be chilled during a shift can be considerable, especially during times of increased beer consumption. During heavy periods, the bartender is usually in constant motion and requires that the glasses, the liquor and the beer all be readily accessible so that he can quickly serve his customers.

Oftentimes, the bartender will run out of glasses and will have to reach into the glass washing machine and pull out glasses that are not chilled. In point of fact, if the washing has been recent, the glasses are relatively warm. If he attempts to cool these glasses by putting them into a top-loading chill chest or refrigerator, it takes a good 20 to 30 minutes for the glasses to reach the proper serving temperature. Most chill cabinets or refrigerators basically serve as batch-processing units in which the glasses are top-loaded into the chill cabinet one batch at a time usually on trays stacked one on top of the other. Thus there are various layers of glasses which are to be chilled.

If during a busy shift the bartender sees that he is going to need more glasses than are contained in the chill cabinet, his tendency is to grab glasses out of the glass washer and put them on top of the glasses that are already in the chill cabinet. The result is that the glasses which come out of the hot dishwasher are insufficiently chilled because the glasses which are last put into the chill cabinet are the first to be withdrawn. This is a last in, first out system and is prevalent in most bars. The trouble with such a system is that the glasses are not properly chilled which is an annoyance to the customers.

Moreover, as is usual, the chill cabinets are beneath the bar such that as the chill cabinet is emptied of glasses, the bartender must reach deep to the chill cabinet in order to pull out the glasses. On a busy evening, the amount of back strain this can cause is considerable, along with the inconvenience of not having the chilled glasses at a point reasonably close to the beer taps.

In short, in the past the chilling of glasses for beer or other spirits has been one involving batch cooling, without consideration of the requirements of the bartender.

SUMMARY OF THE INVENTION

Rather than utilizing a batch process for the chilling of the glasses, in the subject invention a chill cabinet is provided which has a number of trays mounted therein. The trays are driven by a conveyor from the bottom of the chill cabinet to the top of the chill cabinet, with the trays being loadable into the bottom of the chill cabinet and withdrawn from an aperture at the top of the chill cabinet. What is accomplished by such an arrangement is a last in, last out flow in which the glasses are chilled as the trays on which they sit move upwardly in the chill cabinet. This means that the residence time of a glass in the chill cabinet is maximized since it must travel from the bottom-loading slot to the top exit slot or orifice before it is extracted. The exit orifice of the chill cabinet is at the top such that the chilled glasses are available at about waist high for the bartender. The time for the chilling processes is the time that the glasses are resident in the chill cabinet starting from the time when they are inserted at the base of the chill cabinet until the time they move to the top position.

The result is that relatively warm or hot washed glasses may be placed on a tray and inserted into the chill cabinet at the bottom. Over a period, for instance, 20 to 30 minutes, depending on the glass withdrawal rate, the hot glasses are suitably chilled by the time they make it to the top position.

In one embodiment, the drive for the endless loop conveyor chain drive is controlled by a foot petal which is actuatable by the bartender to present another tray at the top of the chill cabinet after the previously presented and now empty tray has been removed. The appropriately chilled glasses are presented to the bartender at approximate waist level, where he can grab a glass, place it under the tap and serve the beer, all in an efficient manner minimizing time and motion.

The result is that in a busy bar, the bartender now has the ability to quickly serve beer in chilled glasses without having to move significantly from his position at the taps.

In order for the glasses to be accessible at the exit aperture of the chill cabinet, in one embodiment the trays carrying the glasses are tilted forwardly such that the glasses slide down by gravity towards the exit orifice. A stop or lip at the exit orifice edge of the tray prevents the glasses from coming out, other than by extraction by the bartender. In one embodiment, the glasses may be arranged in rows left to right, with each of the glasses in a row starting at the back of the cabinet and moving forwardly and downwardly to the exit aperture.

In order to assist in the gravity-induced movement of the glasses, the trays themselves may carry a rack of internal rollers so that the glasses, rather than sliding down a ramp, move towards the exit aperture by virtue of freely rotating rollers which support the glasses.

In a further embodiment, a braking mechanism is provided to lock the rollers such that the glasses cannot move towards the exit aperture, thus to prevent the crashing of the glasses into each other. When a glass is removed at the exit aperture, this removal is sensed electro-optically and the brake on the rollers is released for predetermined period of time to allow the glasses to move downwardly towards the exit aperture, at which point the rollers are again locked.

As a result, chilled glasses are made accessible to the bartender at a point reasonably close to the tap used to fill the glasses. They are appropriately chilled because they have had at least a minimum amount of time in the chill cabinet, with the time being associated with the length of time it takes for a tray of glasses at the bottom of the chill cabinet to be moved to the top most position. Since the hot, recently washed glasses are inserted at the base of the chill cabinet they will not be withdrawn immediately. Rather the glasses which are on the top most tray has had a relatively long resident time in the chill cabinet are first removed or extracted.

In so doing, the usual frenetic activity of the bartender is reduced due to this convenient method of providing an ample supply of properly chilled glasses. While any type of chilled containers are within the scope of this invention, the subject invention will be descried in terms of beer glasses for convenience.

In summary, for bartending, in order to avoid batch chilling of beer glasses and the like in which the last glasses put into a refrigerator are the first pulled out and are thus not properly chilled, a last in, last out glass chilling system provides a supply of properly chilled beer glasses, even when newly washed warm glasses are to be chilled. In one embodiment, the last in, last out glass chilling system includes a series of trays on a conveyor in the cabinet with each tray loaded with glasses. The conveyor moves the trays upwardly in the chill cabinet, with the chilling occurring during the time that the tray of glasses moves from a bottom position to a top position. This assures that, unlike batch chilling, properly chilled glasses are always available.

In one embodiment, a tray of glasses is in inserted at the base of the chill cabinet, with the conveyor being motorized to move the trays within the chill cabinet in an upward direction. Topmost tray is presented at an upper aperture in the chill cabinet, with the chilled glasses being extractable from this upper aperture. In a preferred embodiment, the trays are slanted downwardly such that glasses on the trays move by gravity towards this upper aperture. As glasses are removed from the tray, other glasses slide into place.

In order to prevent the glasses from crashing into each other, the glasses are supported by rollers carried by the tray, with the rollers being braked after a glass has been removed by the bartender. The braking may be effectuated by electro-optical means which brakes the rollers, in one embodiment, by an electrometric material moved into engagement with the rollers. In a further embodiment, the glasses are arranged in rows across the rollers, with the glasses in adjacent rows being separated by a barrier, and with each set of rollers associated with a row being independently rotatable.

BRIEF DESCRIPTION OF THE DRAWINGS

These and other features of the subject invention will be better understood in connection with the Detailed Description in conjunction with the Drawings, of which.

DETAILED DESCRIPTION

Figure 1:
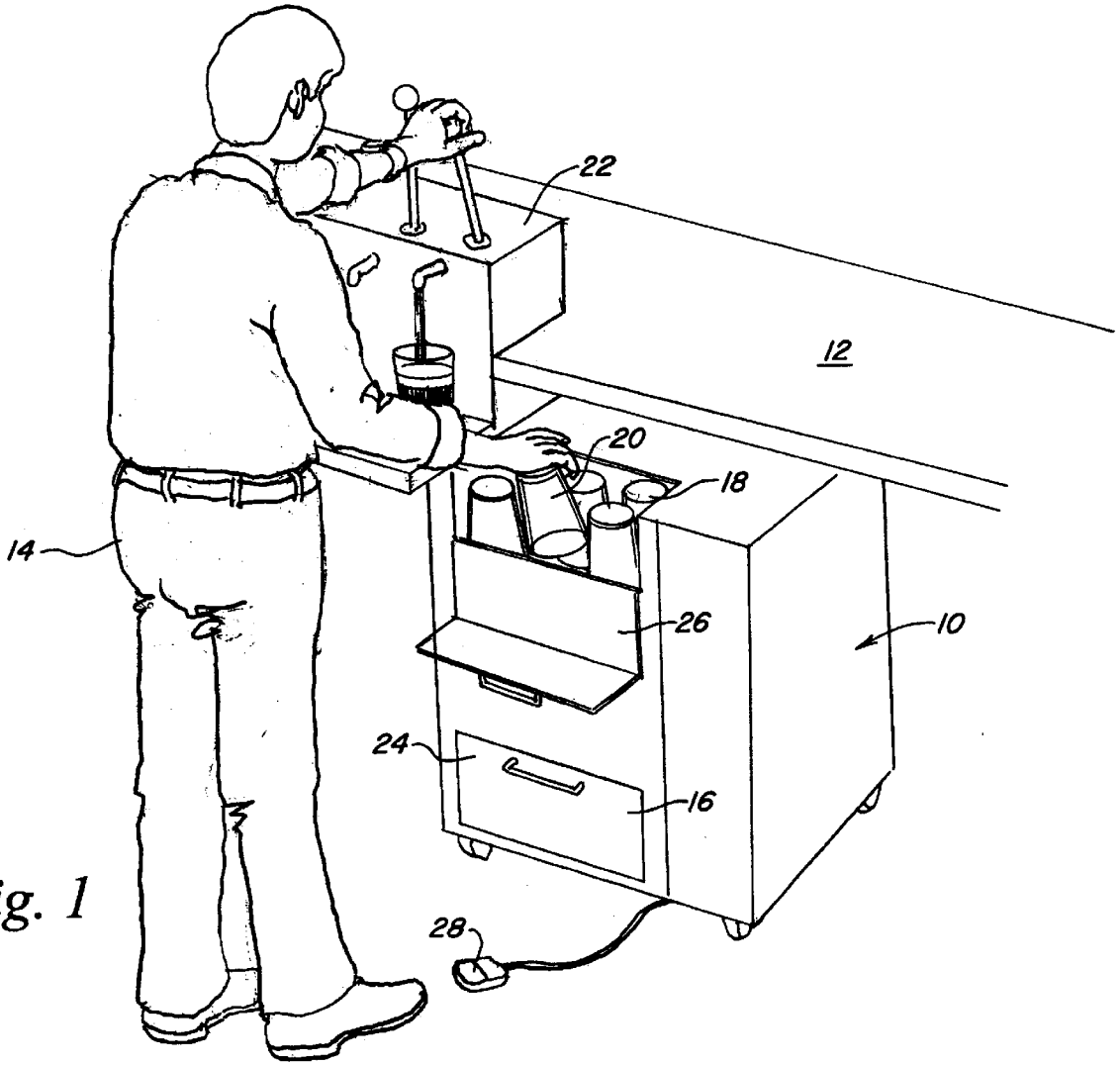
FIG. 1 is a diagrammatic illustration of the use of the subject chill cabinet showing a bartender extracting a chilled glass from the top of the chill cabinet, with the glass being provided on a tray which has initially been inserted at the base of the chill cabinet and has been moved upwardly under the control of the bartender's foot and a foot pedal or actuator switch.

Referring now to FIG. 1, a chill cabinet 10 is provided under a bar 12 adjacent to a bartender 14. Chill cabinet 10 has a lower entrance aperture or orifice 16 into which trays of washed glasses may be inserted, whereas cabinet 10 has a top exit aperture 18 at which a glass 20 may be removed in a chilled condition and moved to a beer tap 22.

Cabinet 10 has a lower door 24 for sealing the cabinet once the trays have been inserted into the lower aperture and a door 26 for sealing the cabinet to maintain the temperature of the chill cabinet prior to the time a glass is extracted therefrom.

As will be described hereinafter, trays of glasses are moved upwardly in cabinet 10 via a conveyor, the motion of which is actuated by a foot switch 28 in one embodiment.

In operation, the bartender inserts a tray of recently washed glasses by opening door 24 and inserting the glasses into the cabinet through lower aperture 16. The last in tray of glasses moves upwardly in the cabinet and therefore has a dwell time in the cabinet sufficient to provide appropriate chilling for the glasses on the tray. When the glasses reach the top most position as illustrated by the glasses in aperture 18, they are properly chilled and may be placed under a tap for filling.

It will be appreciated that the chilling apparatus is conveniently located adjacent to the tap and within easy reach of the bartender. Thus the bartender does not have to move from the tap to provide his customers with chilled glasses containing beer or other beverages.

Figure 2:
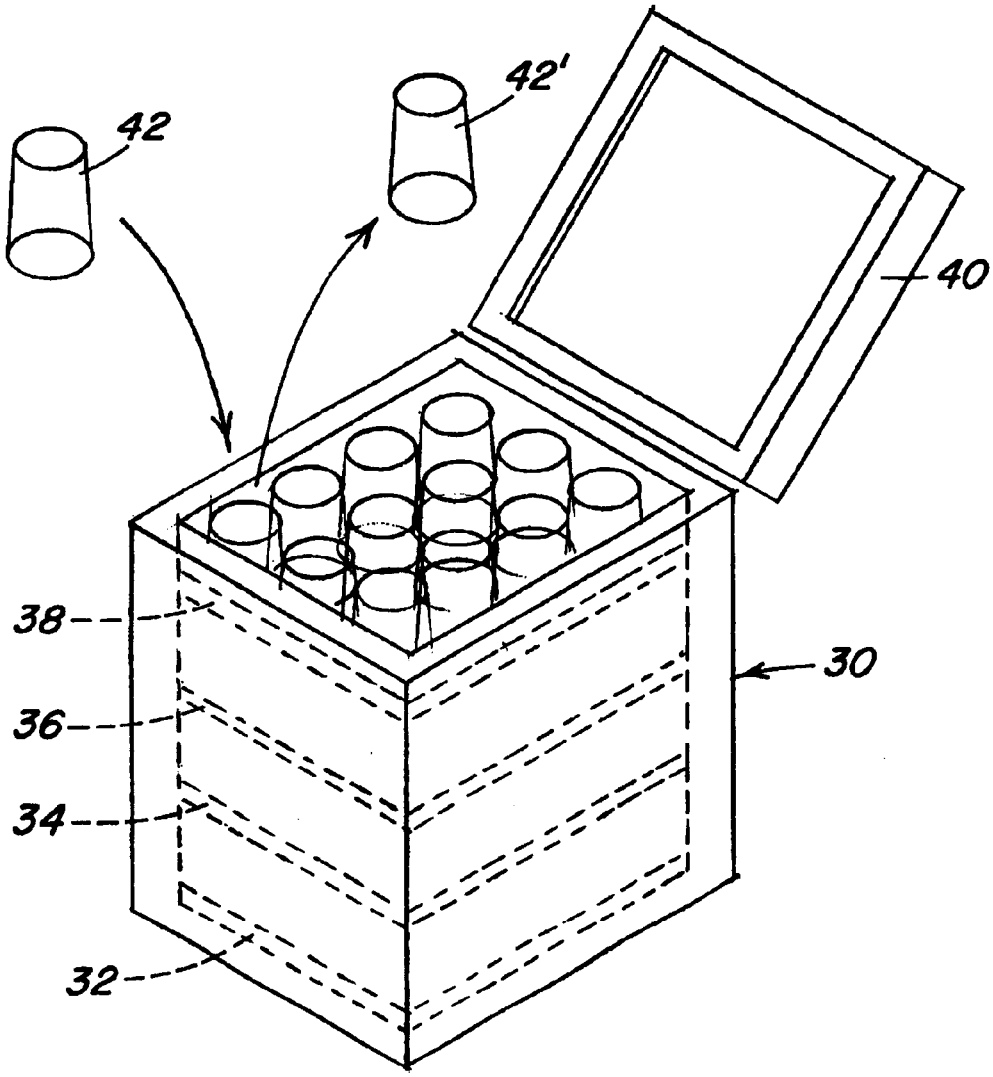
Fig. 2 (Prior Art)
FIG. 2 is a diagrammatic illustration of a prior art chill chest in which layers of glasses on trays are stacked within the chill chest, with a last in warm glass deposited on top of the glasses in the chill chest, where it is immediately removable in an unchilled condition.

Referring to FIG. 2, a prior art chill cabinet or chest 30 is shown having a number of trays 32, 34, 36 and 38, with each tray carrying a set of glasses. It will be appreciated that the glasses are chilled once the top 40 of cabinet 30 is lowered. However, it will be appreciated that this is a batch process. During a busy shift, a new washed glass 42 is placed in the top of the chill cabinet where it is quickly removed as seen at 42' without having been properly chilled. This is because the properly chilled glasses are stacked underneath in layers in the chill cabinet. Thus, this batch chilling process is ineffectual especially when being used at a time of day when there are many customers requiring chilled glasses. Moreover, as the glasses are removed from chill cabinet 30 the bartender must reach deeper and deeper into the cabinet in order to extract a glass.

Figure 3:
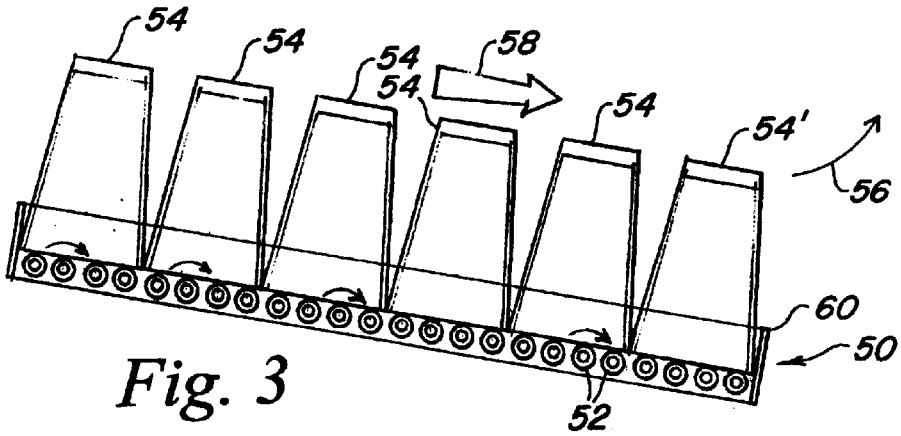
FIG. 3 is a diagrammatic representation of a tray for use in chill cabinet of FIG. 1 in which the tray is provided with a number of rollers supporting glasses thereupon, with the tray being slanted in a downward direction so as to permit removal of the glasses as they slide down the tray by virtue of gravity.

Rather than batch processing, and referring now to FIG. 3, a tray 50 is provided with rollers 52 that support glasses 54 at a slight incline such that as glass 54' is removed as illustrated by arrow 56, the glass is moved downwardly as illustrated by arrow 58 until it is stopped by a lip 60 of tray 50.

Figure 4:
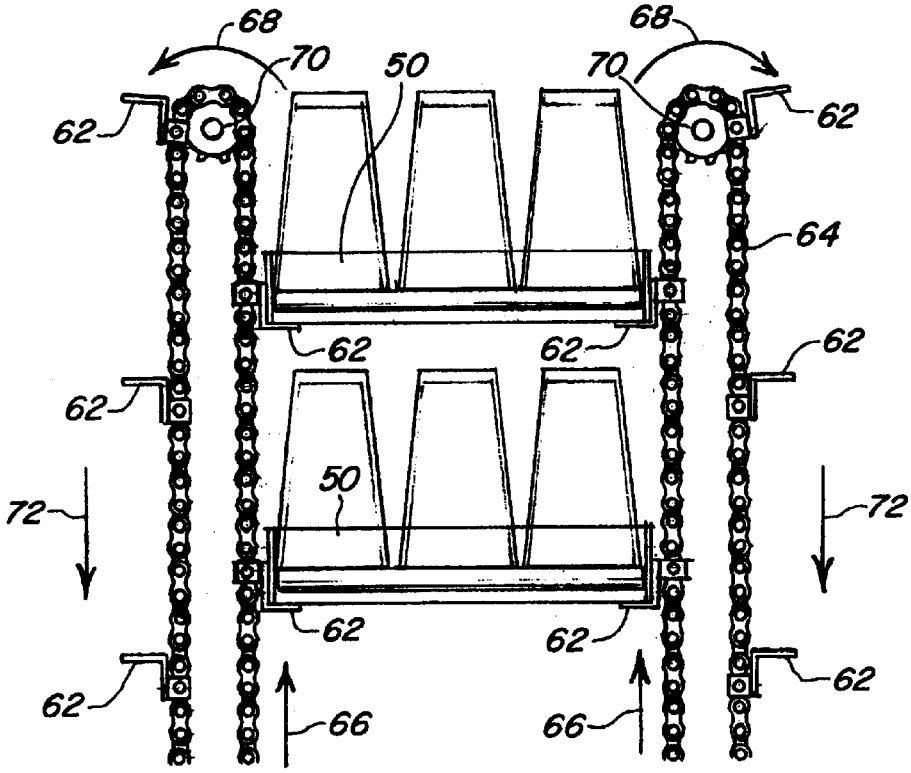
FIG. 4 is a diagrammatic illustration of the conveyor system used to support the trays of glasses in the chill cabinet of FIG. 1, illustrating a chain drive conveyor system for the supporting of trays as they move upwardly in the cabinet.

In one embodiment, these are the trays which are inserted into the chill cabinet of FIG. 1 and are driven upwardly by a conveyor system shown in FIG. 4.

As illustrated in FIG. 4, each tray 50 is supported by angled supports 62 on respective conveyor chains 64 and 66. In one embodiment, there are four conveyor chains, two supporting the tray at its rear most portion and two supporting the tray at its front-most portion. As the tray moves upwardly as illustrated by arrow 66, the respective chains are driven as illustrated by arrow 68 such that the tray supported by the angled supports moves upwardly, with the chains which in one embodiment ganged together. The chains go over respective sprockets 70 and then move downwardly as illustrated by arrow 72 such that angled supports 62, once out of operative engagement with a tray, are moved to the bottom of the cabinet where they are adapted to receive the next tray.

Figure 5:
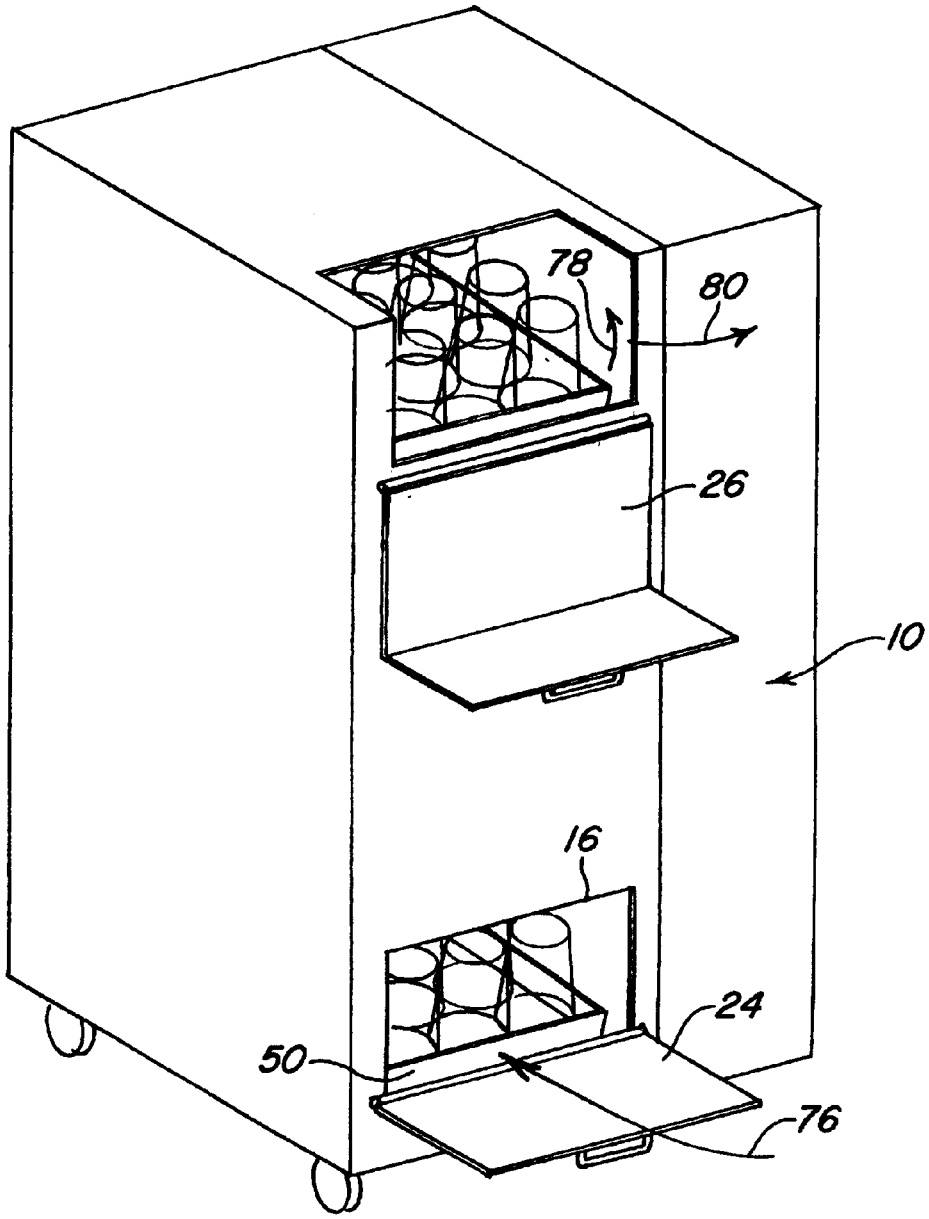
FIG. 5 is a diagrammatic illustration of the chill cabinet of FIG. 1, illustrating the insertion of a tray of glasses through a bottom aperture and the removal of glasses from a tray which has been transported upwardly through the cabinet so that the glasses are appropriately chilled.

Referring now to FIG. 5, cabinet 10 of FIG. 1 is shown with a tray 50 of newly washed and presumably warm glasses being inserted as illustrated by arrow 76 into lower aperture 16 of cabinet 10. With the upward motion of conveyor of FIG. 4, the trays move as illustrated by arrow 78, with a glass being removable as illustrated by arrow 80.

Thus when a new tray is inserted through aperture 16 having opened door 24, it moves upwardly within the chill cabinet, with glasses on the tray being removable sometime thereafter by opening door 26.

Figure 6:
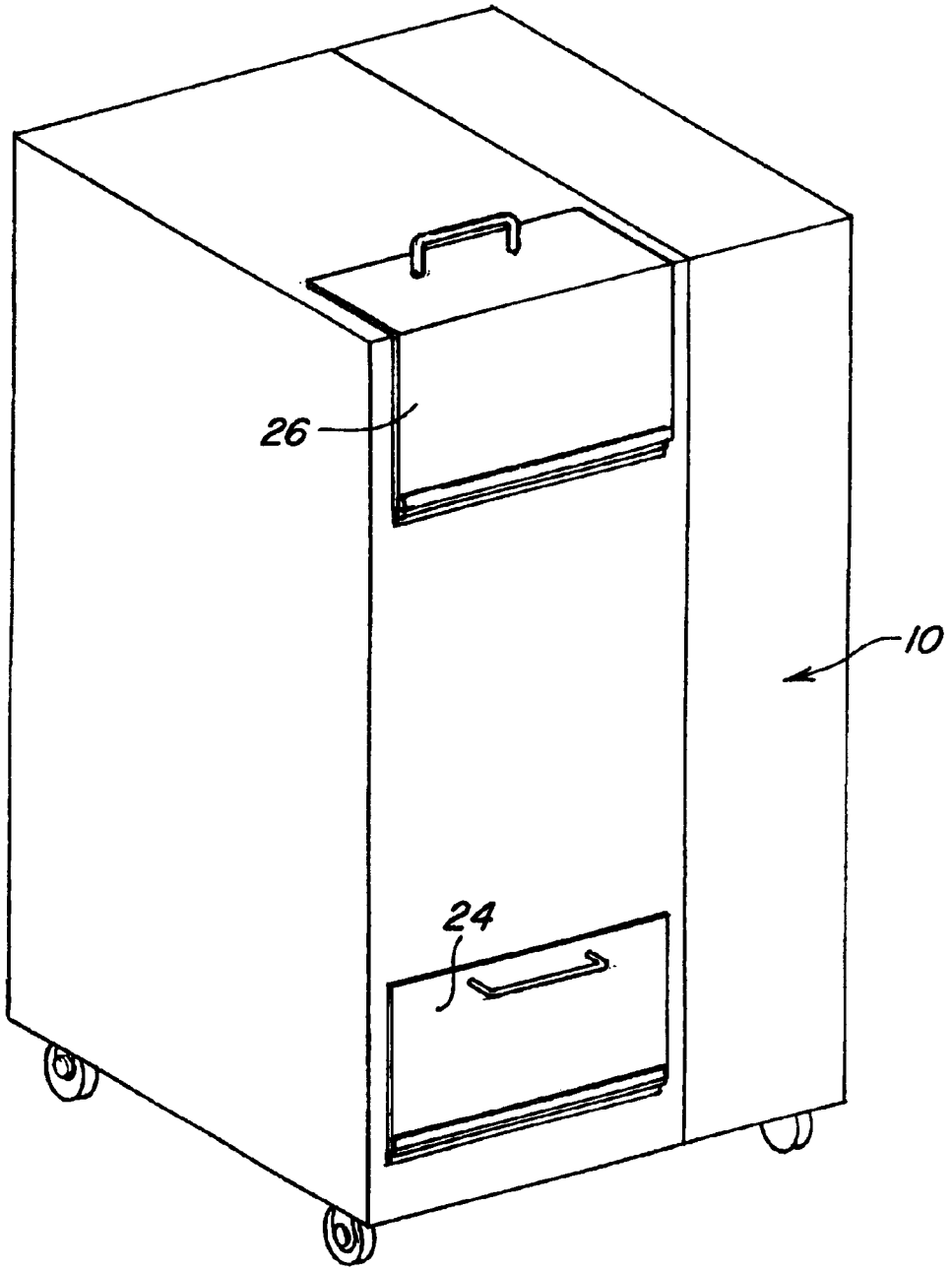
FIG. 6 is a diagrammatic illustration of the chill cabinet of FIG. 5, illustrating the doors utilized to seal the lower and upper apertures.

Referring to FIG. 6, the closed position of doors 24 and 26 is illustrated thus to illustrate that the chill cabinet may be sealed so as to permit glasses to be chilled as quickly as possible. The doors also prevent the glasses from warming should no doors be provided.

Figure 7:
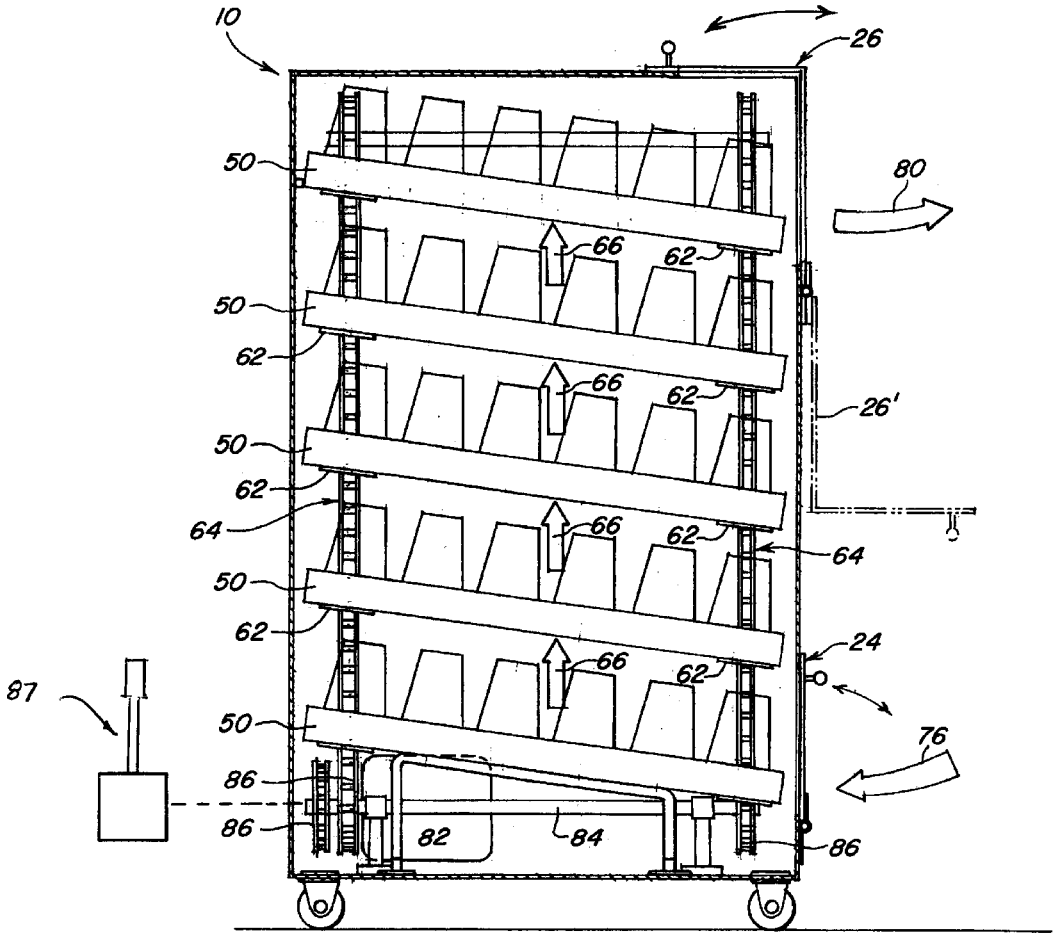
FIG. 7 is a diagrammatic illustration of the movement of the trays in an upward direction in the chill cabinet, also showing the downward slant of the trays to permit movement of the glasses in a direction towards the top exit aperture of the cabinet.

Referring to FIG. 7, a series of downwardly tilted trays 50 supported on angle support 62 provide for the storage of the trays of glasses within chill cabinet 10. Here it can be seen that conveyors 64 are ganged together and driven in one embodiment by a motor 82 with drive chains 64 through the use of a shaft 84 that is coupled to sprockets 86 which drive the respective chains. Alternatively, the chains can be manually driven by a lever actuated ratcheting system 87. Here it can be seen that the trays are inserted as illustrated by arrow 76, with glasses being extracted as illustrated by arrow 80. Door 26 is shown in its open position as illustrated by dotted outline 26'. Again, the motion of trays upwardly in the cabinet is illustrated by arrow 66.

Figure 8:
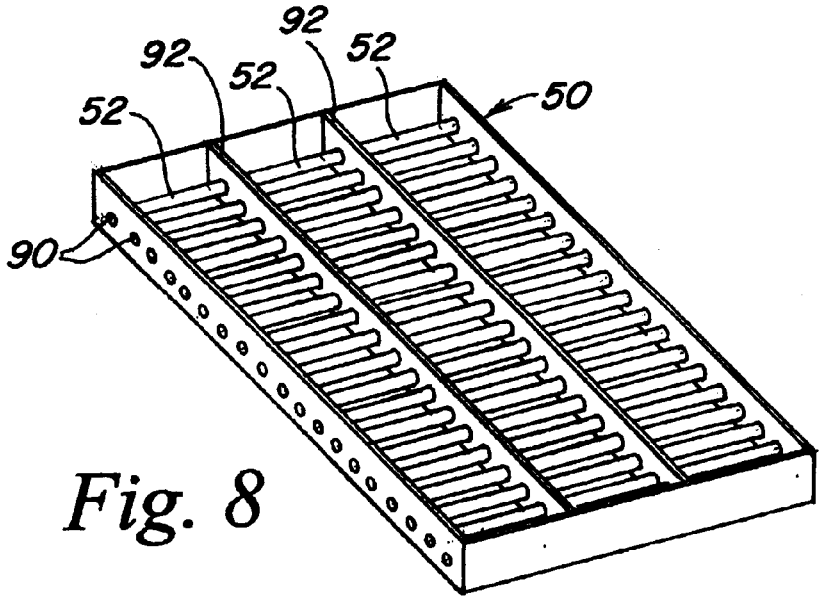
FIG. 8 is a diagrammatic illustration of a tray for use in the chill cabinet of FIG. 1, in which the tray is provided with a series of laterally running rollers to support glasses thereon, with the rollers being independently rotatable, and also showing dividing barriers running the length of the tray so as to permit the stacking of glasses three across.

Referring now to FIG. 8, tray 50 may be provided with a number of independently rotatable rollers 52 with the rollers supported on pins or axles 90 which run transverse to the tray.

In one embodiment, the tray is provided with longitudinally dividing members 92 that separate each tray into three rows. It is noted that these dividers are for the purpose of organizing the glasses on the trays so that they may be extracted one at a time from a row.

Figure 9:
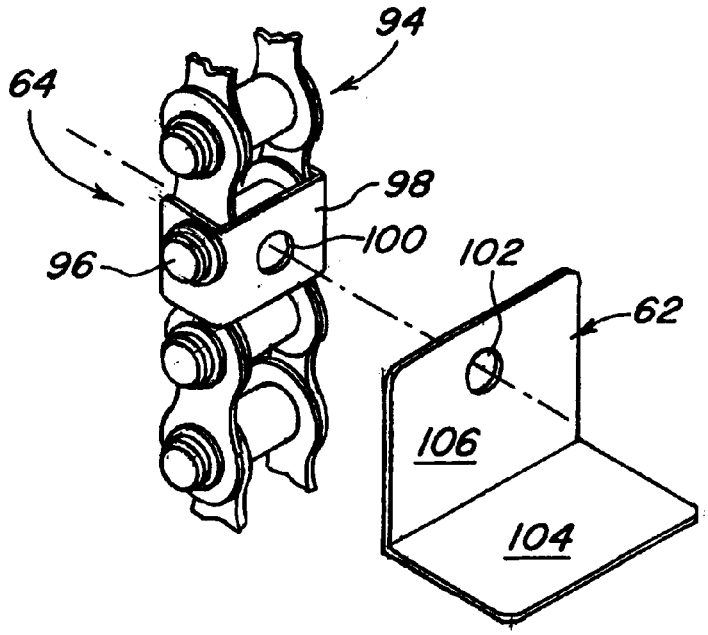
FIG. 9 is an exploded view of a tray retaining a member attached to a link in the conveyor chain for the conveyor of FIG. 7; and, FIG. 10 is a diagrammatic illustration of the braking system for the rollers for the tray of FIG. 8, illustrating movement of a electromechanical braking member into contact with the lower surfaces of the rollers to stop the motion of the rollers upon detection of a vacancy in a row of glasses to be positioned on tray of FIG. 8, also showing release of the brake to permit the downward movement of glasses toward the end of tray.

With respect to the angled support 62 and referring now to FIG. 9, a portion 94 of chain 64 is illustrated. Here a pinion 96 that joins the individual links of the chain is provided with a bracket 98 having an aperture 100 therethrough. Angle support device 62 is provided with an aperture 102 through which a bolt is inserted so as to mount angled support 62 to the chain. Here the angled support is a unitary member having a horizontally running portion 104 and an upstanding portion 106.

Figure 10:
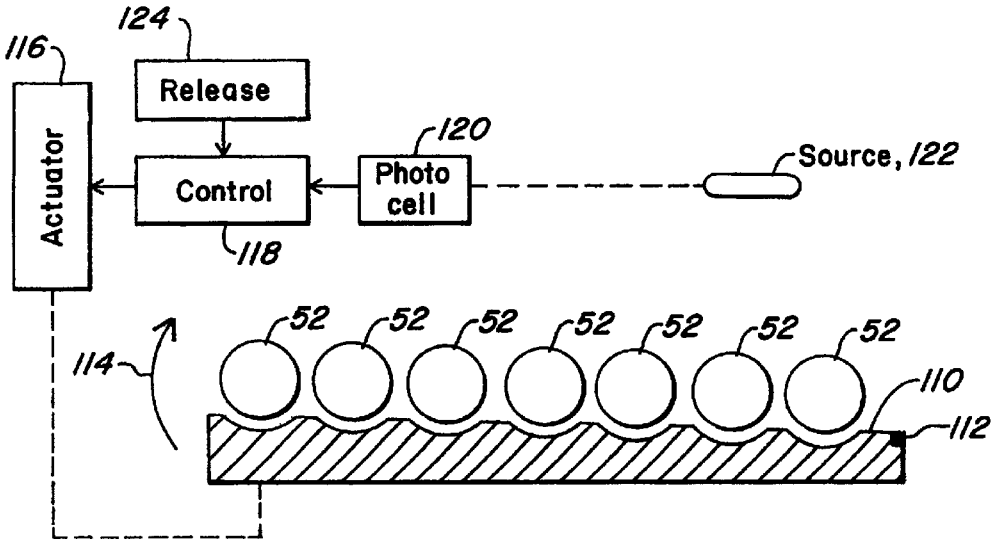

Referring now to FIG. 10, a braking system for rollers 52 is illustrated. As mentioned hereinbefore, it may become desirable to be able to brake the downward motion of the glasses and in order to do so, an electromagnetic break 110 is shown pivoted at 112 so that its upward motion as shown at 114 brakes the rollers against rotation. Here it can be seen that an actuator 116 drives the brake 110 in the upward direction upon actuation, with actuator being under the control of the control unit 118. Note that brake 110 may include an elastomeric member.

Control unit 118 is coupled to a photocell 120 which is illuminated by a source 122. Control unit 118 senses when there is the absence of a glass at the lowest position of tray 50. Control unit 118 then causes actuator 116 to actuate brake 110 so as to prevent any further glasses from sliding down. A release 124 is coupled to control unit 118 to provide a controlled release of the glasses so glasses can slide down the inclined tray in a controlled fashion. Release 124 may be footswitch actuated or on a timer.

In this manner, collision of the glasses is controlled so that the glasses may be dispensed one at a time without the glasses crashing into each other.

What is therefore been provided is a convenient method and apparatus for chilling glasses such that glasses that are last into the chill cabinet are last out, thereby permitting the glasses to dwell within the chill cabinet a sufficient time to reach an optimum chill temperature.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. Apparatus for assuring that glasses are properly chilled prior to filling, comprising:

a refrigerated cabinet having an upper portion and a lower portion;

a tray adopted to carry glasses to be chilled; and, a conveyor for moving glasses on said tray from said lower position to said upper position within said cabinet, whereby glasses loaded onto said tray at said lower position are chilled as they move in said cabinet to said upper position for extraction, thus to establish a last in, last out glass flow to assure availability of properly chilled glasses.

2. The apparatus of claim 1, wherein said conveyor includes tray engaging members for supporting trays in said cabinet.

3. The apparatus of claim 2, wherein said tray engaging members position the trays supported thereby at a slant towards the front of said cabinet such that glasses extracted from the front of a tray leave a space that is filled by the sliding down of the next higher glass.

4. The apparatus of claim 3, wherein said tray includes a series of rollers for supporting said glasses, thus to facilitate downward movement of said glasses due to gravity.

5. The apparatus of claim 4, wherein said tray includes a brake for braking said rollers against rotation to prevent glasses carried thereby from crashing into each other.

6. The apparatus of claim 3, wherein said tray includes a brake for braking the glasses from moving down said tray.

7. The apparatus of claim 1, wherein said cabinet includes a lower aperture in the front face of said cabinet at said lower position for receiving a tray of glasses.

8. The apparatus of claim 7, wherein said cabinet includes a door for selectively sealing said lower aperture.

9. The apparatus of claim 1, wherein said cabinet includes an upper aperture at said upper position.

10. The apparatus of claim 9, wherein said cabinet includes a door at said upper aperture for selecting sealing said cabinet to permit extraction from glasses from a tray moved to said upper position.

11. The apparatus of claim 1, wherein said cabinet includes a motor for driving said conveyor and means for selectively actuating said motor to move the trays carried by said conveyor upwardly in said cabinet.

12. The apparatus of claim 11, wherein said selective actuating means includes a foot switch.

13. The apparatus of claim 1, wherein said conveyor includes manual means for the movement thereof.

* * * * *